US006221826B1

(12) United States Patent
Surutzidis et al.

(10) Patent No.: US 6,221,826 B1
(45) **Date of Patent: *Apr. 24, 2001**

(54) LAUNDRY ADDITIVE PARTICLE HAVING MULTIPLE SURFACE COATINGS

(75) Inventors: Athanasios Surutzidis, Hamilton; Brent Michael Heist; Michael Jude LeBlanc, both of Cincinnati, all of OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/381,551

(22) PCT Filed: Feb. 27, 1998

(86) PCT No.: PCT/IB98/00242

§ 371 Date: Sep. 20, 1999

§ 102(e) Date: Sep. 20, 1999

(87) PCT Pub. No.: WO98/42818

PCT Pub. Date: Oct. 1, 1998

Related U.S. Application Data

(60) Provisional application No. 60/041,433, filed on Mar. 20, 1997.

(51) Int. Cl.[7] ..... C11D 3/22; C11D 3/50

(52) U.S. Cl. ..... 510/349; 510/101; 510/276; 510/441; 510/470; 510/473; 510/474; 510/475; 510/507; 510/511; 510/512; 510/513

(58) Field of Search ..... 510/101, 349, 510/441, 276, 470, 473, 474, 475, 507, 511, 512, 513

(56) References Cited

U.S. PATENT DOCUMENTS

| | | | | |
|---|---|---|---|---|
| 2,809,895 | | 10/1957 | Swisher | 99/140 |
| 4,020,156 | * | 4/1977 | Murray et al. | 424/76.6 |
| 4,304,675 | | 12/1981 | Corey et al. | 252/8.6 |
| 4,539,135 | | 9/1985 | Ramachandran et al. | 252/174.11 |
| 4,713,193 | | 12/1987 | Tai | 252/91 |
| 5,137,646 | * | 8/1992 | Schmidt et al. | 510/515 |
| 5,141,664 | | 8/1992 | Corring et al. | 252/90 |
| 5,154,842 | * | 10/1992 | Walley et al. | 510/523 |
| 5,188,753 | * | 2/1993 | Schmidt et al. | 510/395 |
| 5,230,822 | | 7/1993 | Kamel et al. | 252/174.13 |
| 5,258,132 | | 11/1993 | Kamel | 252/94 |
| 5,324,444 | * | 6/1994 | Berry et al. | 510/101 |
| 5,336,665 | | 8/1994 | Carner-Gray et al. | 512/4 |
| 5,648,328 | * | 7/1997 | Angell et al. | 510/441 |
| 5,656,584 | * | 8/1997 | Angell et al. | 510/441 |
| 5,691,303 | * | 11/1997 | Pan et al. | 512/4 |
| 5,840,668 | * | 11/1998 | Behan et al. | 510/349 |
| 5,858,959 | * | 1/1999 | Surutzidis et al. | 510/507 |
| 6,025,319 | * | 2/2000 | Surutzidis et al. | 510/441 |

FOREIGN PATENT DOCUMENTS

| | | | |
|---|---|---|---|
| 137599 | 2/1902 | (DE) . | |
| 248508 | 6/1912 | (DE) . | |
| 535942 B1 | 4/1993 | (EP) | C11D/3/50 |
| 536 942 A2 | 4/1993 | (EP) | C11B/9/00 |
| 4-218583 | 8/1992 | (JP) | C09K/3/00 |
| WO 94/28107 | 12/1994 | (WO) | C11D/3/50 |

* cited by examiner

*Primary Examiner*—Lorna M. Douyon
(74) *Attorney, Agent, or Firm*—Richard S. Echler, Sr.; Kim W. Zerby; Steven W. Miller

(57) ABSTRACT

A laundry additive particle having multiple coatings and compositions employing the particle are provided. The laundry additive particle comprises a central core particle with the core particle comprising a porous carrier core material and a glassy encapsulating material intermixed with the carrier material. The glassy encapsulating material is derived from one or more at least partially water-soluble hydroxylic compounds having an anhydrous, nonplasticized, glass transition temperature, $T_g$, of at least about 0° C. An optional intermediate encapsulating material may be coated on the central core particle. The intermediate encapsulating material may comprise a carbohydrate material having an anhydrous nonplasticized, glass transition temperature, $T_g$ of at least about 130° C. Lastly, an external coating material is coated on the core particle or the intermediate encapsulating material which provides the laundry additive particle with a substantially non-tacky surface. The external coating material is derived from one or more at least partially water soluble or dispersible compounds selected from the group consisting of waxes, water-soluble polymers, fatty compounds, carbohydrates, cellulose and cellulose derivatives, natural and synthetic gums, silicates, borates, phosphates, chitin and chitosan, and mixtures thereof. The laundry additive particle has a hygroscopicity value of less than about 80%. Preferably, a laundry or cleaning agent such as a perfume is supported on or contained in the porous carrier.

20 Claims, No Drawings

LAUNDRY ADDITIVE PARTICLE HAVING MULTIPLE SURFACE COATINGS

This application claims benefit of provision application No. 60/041,433 Mar. 20, 1997. This application is a 371 of PCT/IB98/00242 Feb. 27, 1998.

FIELD OF THE INVENTION

The present invention generally relates to laundry additive particles having multiple surface coatings and, more particularly, to perfume loaded zeolite particles having multiple surface coatings.

BACKGROUND OF THE INVENTION

Most consumers have come to expect scented laundry products and to expect that fabrics which have been laundered also have a pleasing fragrance. Perfume additives make laundry compositions more aesthetically pleasing to the consumer, and in some cases the perfume imparts a pleasant fragrance to fabrics treated therewith. However, the amount of perfume carryover from an aqueous laundry bath onto fabrics is often marginal. Industry, therefore, has long searched for an effective perfume deliver system for use in laundry products which provides long-lasting, storage-stable fragrance to the product, as well as fragrance to the laundered fabrics.

Laundry and other fabric care compositions which contain perfume mixed with or sprayed onto the compositions are well known from commercial practice. Because perfumes are made of a combination of volatile compounds, perfume can be continuously emitted from simple solutions and dry mixes to which the perfume has been added. Various techniques have been developed to hinder or delay the release of perfume from compositions so that they will remain aesthetically pleasing for a longer length of time. To date, however, few of the methods deliver significant fabric odor benefits after prolonged storage of the product.

Moreover, there has been a continuing search for methods and compositions which will effectively and efficiently deliver perfume from a laundry bath onto fabric surfaces. As can be seen from the following disclosures, various methods of perfume delivery have been developed involving protection of the perfume through the wash cycle, with release of the perfume onto fabrics. U.S. Pat. No. 4,096,072, Brock et al. issued Jun. 20, 1978, teaches a method for delivering fabric conditioning agents, including perfume, through the wash and dry cycle via a fatty quaternary ammonium salt. U.S. Pat. No. 4,402,856, Schnoring et al. issued Sep. 6, 1983, teaches a microencapsulation technique which involves the formulation of a shell material which will allow for diffusion of perfume out of the capsule only at certain temperatures. U.S. Pat. No. 4,152,272, Young, issued May 1, 1979, teaches incorporating perfume into waxy particles to protect the perfume through storage in dry compositions and through the laundry process. The perfume assertedly diffuses through the wax on the fabric in the dryer. U.S. Pat. No. 5,066,419, Walley et al. issued Nov. 19, 1991, teaches perfume dispersed with a water-insoluble nonpolymeric carrier material and encapsulated in a protective shell by coating with a water-insoluble friable coating material. U.S. Pat. No. 5,094,761, Trinh et al. issued Mar. 10, 1992, teaches a perfume/cyclodextrin complex protected by clay which provides perfume benefits to at least partially wetted fabrics.

Another method for delivery of perfume in the wash cycle involves combining the perfume with an emulsifier and water-soluble polymer, forming the mixture into particles, and adding them to a laundry composition, as is described in U.S. Pat. No. 4,209,417, Whyte, issued Jun. 24, 1980: U.S. Pat. 4,339,356, Whyte, issued Jul. 13, 1982; and U.S. Pat. No. 3,576,760, Gould et al. issued Apr. 27, 1971. However, even with the substantial work done by industry in this area a need still exists for a simple, more efficient and effective perfume delivery system which can be mixed with laundry compositions to provide initial and lasting perfume benefits to fabrics which have been treated with the laundry product.

The perfume can also be adsorbed onto a porous carrier material, such as a polymeric material, as described in U.K. Pat. Pub. 2,066,839, Bares et al. published Jul. 15, 1981. Perfumes have also been adsorbed onto a clay or zeolite material which is then admixed into particulate detergent compositions. Generally, the preferred zeolites have been Type A or 4A Zeolites with a nominal pore size of approximately 4 Angstrom units. It is now believed that with Zeolite A or 4A, the perfume is adsorbed onto the zeolite surface with relatively little of the perfume actually absorbing into the zeolite pores. While the adsorption of perfume onto zeolite or polymeric carriers may perhaps provide some improvement over the addition of neat perfume admixed with detergent compositions, industry is still searching for improvements in the length of storage time of the laundry compositions without loss of perfume characteristics, in the intensity or amount of fragrance delivered to fabrics, and in the duration of the perfume scent on the treated fabric surfaces.

Therefore, a need remains for a perfume delivery system which provides satisfactory perfume odor during use and thereafter from the dry fabric, but which also provides prolonged storage benefits and reduced product odor intensity.

BACKGROUND ART

U.S. Pat. No. 4,539,135, Ramachandran et al, issued Sep. 3, 1985, discloses particulate laundry compounds comprising a clay or zeolite material carrying perfume. U.S. Pat. No. 4,713,193, Tai, issued Dec. 15, 1987, discloses a free-flowing particulate detergent additive comprising a liquid or oily adjunct with a zeolite material. Japanese Patent HEI 4[1992]-218583, Nishishiro, published Aug. 10, 1992, discloses controlled-release materials including perfumes plus zeolites. U.S. Pat. No. 4,304,675, Corey et al. issued Dec. 8, 1981, teaches a method and composition comprising zeolites for deodorizing articles. East German Patent Publication No. 248,508, published Aug. 12, 1987, East German Patent Publication No. 137,599, published Sep. 12, 1979: European applications Publication No. 535,942, published Apr. 7, 1993, and Publication No. 536,942, published Apr. 14, 1993, by Unilever PLC U.S. Pat. No. 5,336,665, issued Aug. 9, 1994 to Garner-Gray et al., WO 94/28107, published Dec. 8, 1994: U.S. Pat. No. 5,258,132, issued Nov. 2, 1993, and U.S. Pat. No. 5,230,822, issued Jul. 27, 1993, both to Kamel et al.: U.S. Pat. No. 5,141,664, issued Aug. 25, 1992, to Corring et al. and U.S. Pat. No. 2,809,895, issued Oct. 15, 1957 to Swisher.

SUMMARY OF THE INVENTION

This need is met by the present invention in which a laundry additive particle is provided. The laundry additive particle may be employed to deliver a number of useful laundry and cleaning agents either to or through the wash cycle. The laundry additive particle of the present invention essentially comprises a core of porous carrier material and multiple surface or encapsulation coatings on the core. The laundry additive particle of the present invention is particularly effective at delivering perfume ingredients through the wash to a fabric surface. In traditional perfume delivery systems more than 50% of the perfume material is "lost" due to diffusion of the volatile perfume materials from the product as well as dissolution in the wash and is never delivered to the fabric surface. In the present invention, the multiple coatings effectively entrap the perfume material loaded onto or into the zeolite core. Thus, the perfume material is delivered at a higher rate through the wash to the fabric surface than with traditional perfume delivery systems.

According to a first embodiment of the present invention, a laundry additive particle is provided. The laundry additive particle comprises a central core particle with the core particle comprising a porous carrier core material and a glassy encapsulating material intermixed with the carrier material. The glassy encapsulating material is derived from one or more at least partially water-soluble hydroxylic compounds having an anhydrous, nonplasticized, glass transition temperature, $T_g$, of at least about 0° C. An optional intermediate encapsulating material may then be coated on the central core particle. The intermediate encapsulating material, when present, comprises a carbohydrate material having an anhydrous, nonplasticized, glass transition temperature, $T_g$, of at least about 130° C. An external coating material is then coated on the core particle or, when present, on the intermediate encapsulating material which provides the laundry additive particle with a substantially non-tacky surface. The external coating material is derived from one or more at least partially wash soluble or dispersible compounds selected from the group consisting of waxes, water soluble polymers, fatty compounds, carbohydrates, cellulose and ceullose derivatives, natural and synthetic gums, silicates, borates, phosphates, chitin and chitosan, and mixtures thereof.

Preferably, the porous carrier material is selected from the group consisting of amorphous silicates, crystalline nonlayer silicates, layer silicates, calcium carbonates, calcium sodium carbonate double salts, sodium carbonates, clays, zeolites, sodalites, alkali metal phosphates, macroporous zeolites, chitin microbeads, carboxyalklycelluloses, carboxyalkylstarches, cyclodextrins, porous starches, and mixtures thereof, and most preferably is a zeolite selected from the group consisting of Zeolite X, Zeolite Y, and mixtures thereof.

The laundry additive particle further comprises a laundry or cleaning agent contained in or supported on the porous carrier core. The laundry or cleaning agent is selected from the group consisting of perfumes, bleaches, bleach promoters, bleach activators, bleach catalysts, chelants, antiscalants, dye transfer inhibitors, photobleaches, enzymes, catalytic antibodies, brighteners, fabric-substantive dyes, antifungals, antimicrobials, insect repellents, soil release polymers, fabric softening agents, dye fixatives, pH jump systems, and mixtures thereof and is preferably a perfume material which is contained in a zeolite.

The preferred glassy encapsulating material is a starch, modified starch or starch hydrolysate while the preferred intermediate encapsulating material is a carbohydrate material having a dextrose equivalence, DE, of about 7.5 or less with maltodextrin having a DE of 5 or less the most preferred. The external coating material is preferably a cellulose or cellulose derivative with hydroxypropyl methyl cellulose being the most preferred. The laundry additive particle has a hygroscopicity value of less than about 80% and most preferably less than about 30%. Lastly, the intermediate encapsulating material and/or the external coating may further include an ingredient selected from the group consisting of plasticizers, anti-agglomeration agents, and mixtures thereof.

In accordance with a second embodiment of the present invention, a laundry or cleaning detergent composition is provided. The laundry or cleaning composition comprises from about 0.001% to about 50% by weight of the composition of the laundry additive particle as described above and from about 50% to about 99.999% by weight of the composition of laundry ingredients selected from the group consisting of detersive surfactants, builders, bleaching agents, enzymes, soil release polymers, dye transfer inhibitors, fillers and mixtures thereof. Preferably, the composition includes at least one detersive surfactant and at least one builder.

Accordingly, it is an object of the present invention to provide a laundry additive particle having multiple surface coatings. It is another object of the present invention to provide a laundry and cleaning composition having a laundry additive particle with multiple surface coatings thereon. Lastly, it an object of the present invention to provide a laundry additive particle which can provide improved fabric odor benefits, prolong storage life capabilities, and reduce product odor intensity. These and other objects, features and advantages of the present invention will be recognizable to one of ordinary skill in the art from the following description and the appended claims.

All percentages, ratios and proportions herein are on a weight basis unless otherwise indicated. All documents cited herein are hereby incorporated by reference.

DETAILED DESCRIPTION OF THE PREFERRED EMBODIMENTS

The present invention relates to a laundry additive particle and to laundry and cleaning compositions employing the laundry additive particle. Laundry and cleaning compositions include traditional granular laundry detergents as well as granular bleach, automatic dishwashing, hard surface cleaning, and fabric softening compositions. The laundry additive particle of the present invention provides superior through the wash perfume delivery capabilities as well as minimizes product odor due to evolving volatile perfume ingredients. While not wishing to be bound by theory, it is also believed that the multiple coatings of the particle of the present invention increase the stability of the particle.

The laundry particle of the present invention comprises a core of a porous carrier which is coated or intermixed with a glassy encapsulating material. In an optional step, the core particle may be coated with an intermediate encapsulating material. An external or outer coating is then placed on the core particle or intermediate layer to form the final particle.

The laundry particles of the present invention have a hygroscopicity value of less than about 80%. The "hygroscopicity value", as used herein, means the level of moisture uptake by the particles, as measured by the percent increase in weight of the particles under the following test method. The hygroscopicity value required for the present invention particles is determined by placing 2 grams of particles (approximately 500 micron size particles; not having any moisture barrier coating) in an open container petrie dish under conditions of 90° F. and 80% relative humidity for a period of 4 weeks. The percent increase in weight of the particles at the end of this time is the particles hygroscopicity value as used herein. Preferred particles of the present invention have a hygroscopicity value of less than about 50%, more preferably less than about 30%.

The laundry additive particles of the present invention typically comprise from about 30% to about 97% of the loaded central core particle which itself is about 20% to about 80% glassy encapsulating material, from about 3% to about 50% of intermediate encapsulating material, and from about 3% to about 30% external coating material. The particulate compositions of the present invention also typically comprise from about 0% to about 90%/ of agents useful for laundry or cleaning compositions, preferably from about 10% to about 80%. and more preferably from about 25% to about 80%.

Central Core Particle

As already stated, the central core of the additive particle comprises a mixture of a porous carrier material and a glassy encapsulation material. The two ingredients of the central core may be mixed in a number of different ways with extrusion of the two ingredients being preferred. The central core typically comprises from about 10% to about 60% of the loaded porous carrier with the balance being glassy encapsulation material.

Porous Carrier Material

The porous carrier material, as used herein, means any material capable of supporting (e.g., by absorption onto the surface or adsorption into pores) a deliverable agent such as a laundry or cleaning agent. Such materials include porous solids selected from the group consisting of amorphous silicates, crystalline nonlayer silicates, layer silicates, calcium carbonates, calcium/sodium carbonate double salts, sodium carbonates, clays, zeolites, sodalites, alkali metal phosphates, macroporous zeolites, chitin microbeads, carboxyalkylcelluloses, carboxyalkylstarches, cyclodextrins, porous starches and mixtures thereof.

Preferred porous carrier materials are zeolite X, zeolite Y and mixtures thereof. The term "zeolite" used herein refers to a crystalline aluminosilicate material. The structural formula of a zeolite is based on the crystal unit cell, the smallest unit of structure represented by $$Mm/n[(AlO2)m(SiO2)y]\cdot xH2O$$

where n is the valence of the cation M, x is the number of water molecules per unit cell, m and y are the total number of tetrahedra per unit cell, and y/m is 1 to 100. Most preferably, y/m is 1 to 5. The cation M can be Group IA and Group IIA elements, such as sodium, potassium, magnesium, and calcium.

The zeolite useful herein is a faujasite-type zeolite, including Type X Zeolite or Type Y Zeolite, both with a nominal pore size of about 8 Angstrom units, typically in the range of from about 7.4 to about 10 Angstrom units.

The aluminosilicate zeolite materials useful in the practice of this invention are commercially available. Methods for producing X and Y-type zeolites are well- known and available in standard texts. Preferred synthetic crystalline aluminosilicate materials useful herein are available under the designation Type X or Type Y.

For purposes of illustration and not by way of limitation, in a preferred embodiment, the crystalline aluminosilicate material is Type X and is selected from the following:

$$Na_{86}[AlO_2]_{86}(SiO_2)_{106}].xH_2O. \quad (I)$$

$$K_{86}[AlO_2]_{86}\cdot(SiO_2)_{106}].xH_2O. \quad (II)$$

$$Ca_{40}Na_6[AlO_2]_{86}\cdot(SiO_2)_{106}].xH_2O. \quad (III)$$

$$Sr_{21}Ba_{22}[AlO_2]_{86}\cdot(SiO_2)_{106}\ .xH_2O. \quad (IV)$$

and mixtures thereof, wherein x is from about 0 to about 276. Zeolites of Formula (I) and (II) have a nominal pore size or opening of 8.4 Angstroms units. Zeolites of Formula (III) and (IV) have a nominal pore size or opening of 8.0 Angstroms units.

In another preferred embodiment, the crystalline aluminosilicate material is Type Y and is selected from the following:

$$Na_{56}[AlO_2]_{56}\cdot(SiO_2)_{136}].xH_2O. \quad (V)$$

$$K_{56}[AlO_2]_{56}\cdot(SiO_2)_{136}].xH_2O. \quad (VI)$$

and mixture thereof, wherein x is from about 0 to about 276. Zeolites of Formula (V) and (VI) have a nominal pore size or opening of 8.0 Angstroms units.

In yet another embodiment, the class of zeolites known as, "Zeolite MAP" may also be employed in the present invention. Such zeolites are disclosed and described in U.S. patent application Ser. No. 08/716,147 filed Sep. 16, 1996 and entitled. "Zeolite MAP and Alcalase for Improved Fabric Care."

Zeolites used in the present invention are in particle form having an average particle size from about 0.5 microns to about 120 microns, preferably from about 0.5 microns to about 30 microns, as measured by standard particle size analysis technique.

The size of the zeolite particles allows them to be entrained in the fabrics with which they come in contact. Once established on the fabric surface (with the multiple coatings having been washed away during the laundry process), the zeolites can begin to release their incorporated laundry agents, especially when subjected to heat or humid conditions.

Glass Encapsulating Material

The glassy encapsulating material of the present invention is a glassy material derived from one or more at least partially water-soluble hydroxylic compounds. The at least partially water soluble hydroxylic compounds useful herein are preferably selected from the following classes of materials.

1. Carbohydrates, which can be any or a mixture of: i) Simple sugars (or monosaccharides): ii) Oligosaccharides (defined as carbohydrate chains consisting of 2–35 monosaccharide molecules); iii) Polysaccharides (defined as carbohydrate chains consisting of at least 35 monosaccharide molecules): and iv) Starches including modified starches and starch hydrolysates: and v) hydrogenates of i), ii), iii), and iv).

Both linear and branched carbohydrate chains may be used. In addition chemically modified starches and poly-/oligo-saccharides may be used. Typical modifications include the addition of hydrophobic moieties of the form of alkyl, aryl, etc. identical to those found in surfactants to impart some surface activity to these compounds. Preferred carbohydrate materials are the hydrogenates and in particular hydrogenated starch hydrolysates. Most preferred are hydrogenated starch hydrolysates which are derived from carbohydrates having a dextrose equivalence (DE) of less than 45 and are typically produced by hydrogenation of starch hydrolysates with a DE of less than 45. Suitable examples of hydrogenated starch hydrolysates include those available under the tradenames POLYSORB and LYCASIN from Roquette America of Keokuk, Iowa, and HYSTAR from Lonza of Fairlawn, N.J.

2. All natural or synthetic gums such as alginate esters, carrageenin, agar-agar, pectic acid, and natural gums such as gum arabic, gum tragacanth and gum karaya.

3. Chitin and chitosan.

4. Cellulose and cellulose derivatives. Examples include: i) Cellulose acetate and Cellulose acetate phthalate (CAP); ii) Hydroxypropyl Methyl Cellulose (HPMC): iii) Carboxymethylcellulose (CMC); iv) all enteric/aquateric coatings and mixtures thereof.

5. Silicates. Phosphates and Borates.

6. Polyvinyl alcohol (PVA).

7. Polyethylene glycol (PEG).

8. Plasticizers.

Materials within these classes which are not at least partially water soluble and which have glass transition temperatures, Tg, below the lower limit herein of about 0° C. are useful herein only when mixed in such amounts with the hydroxylic compounds useful herein having the required higher Tg such that the glassy particle produced has the required hygroscopicity value of less than about 80%.

Glass transition temperature, commonly abbreviated "Tg", is a well known and readily determined property for glassy materials. This transition is described as being equivalent to the liquification, upon heating through the Tg region, of a material in the glassy state to one in the liquid state. It is not a phase transition such as melting, vaporization, or sublimation. [See William P. Brennan. "'What is a Tg?' A review of the scanning calorimetry of the glass transition", *Thermal Analysis Application Study* #7, Perkin-Elmer Corporation. March 1973.] Measurement of Tg is readily obtained by using a Differential Scanning Calorimeter.

For purposes of the present invention, the Tg of the hydroxylic compounds is obtained for the anhydrous compound not containing any plasticizer (which will impact the measured Tg value of the hydroxylic compound). Glass transition temperature is also described in detail in P. Peyser, "Glass Transition Temperatures of Polymers", *Polymer Handbook,* Third Edition, J. Brandrup and E. H. Immergut (Wiley-lnterscience: 1989), pp. VI/209–VI/277.

At least one of the hydroxylic compounds useful in the present invention must have an anhydrous, nonplasticized Tg of at least 0° C. and for particles not having a moisture barrier coating, at least about 20° C. preferably at least about 40° C. more preferably at least 60° C. and most preferably at least about 100° C. It is also preferred that these compounds be low temperature processable, preferably within the range of from about 50° C. to about 20° C. and more preferably within the range of from about 60° C. to about 180° C.

Preferably, the hydroxylic compound is a carbohydrate material having a dextrose equivalence, DE, of about 75 or less, more preferably of about 65 or less and most preferably between about 7.5 and about 45 or the hydrogenated equivalent of these carbohydrates. As used herein, the term "dextrose equivalence" and abbreviated "DE", refers to the total amount of reducing sugars expressed as dextrose that is present, calculated as a percentage of the total dry substance. The amount is measured on a scale of 0 to 100 with 100 being the amount present in a pure sugar. The usual technique for determining dextrose equivalence is a volumetric alkaline copper method. Both dextrose equivalence and the methods for measuring dextrose equivalence are well-known in the art particularly in the food and syrup industries. Preferred carbohydrate materials of the first encapsulating material of the present invention include sucrose, hydrogenated starch hydrolysates, glucose, lactose, and starch hydrolysates such as corn syrup with hydrogenated starch hydrolysates being the most preferred.

Intermediate Encapsulating Material

The intermediate encapsulating material according to the present invention may form an optional coating on the central core particle. The intermediate coating can provide an additional barrier to minimize release or leakage of any deliverable agents incorporated into the porous carrier such as a perfume. The intermediate layer, when present, is a carbohydrate material having an anhydrous, nonplasticized, glass transition temperature, $T_g$, of at least about 130° C.. and more preferably at least about 150° C. and most preferably about 175° C.

The carbohydrate of the intermediate encapsulating material can be any or a mixture of: i) Simple sugars (or monosaccharides); ii) Oligosaccharides (defined as carbohydrate chains consisting of 2–35 monosaccharide molecules): iii) Polysaccharides (defined as carbohydrate chains consisting of at least 35 monosaccharide molecules): iv) Starches including modified starches; and v) hydrogenates of i), ii), iii), and iv).

Both linear and branched carbohydrate chains may be used. In addition chemically modified starches and poly-/oligo-saccharides may be used. Typical modifications include the addition of hydrophobic moieties of the form of alkyl, aryl, etc. identical to those found in surfactants to impart some surface activity to these compounds.

The carbohydrate of the intermediate encapsulating material preferably has a dextrose equivalence, DE, of about 7.5 or less, more preferably about 5 or less. Preferably, the carbohydrate of the intermediate encapsulating material is a starch or modified starch, a maltodextrin, or a hydrogenated starch hydrolysate as described above. Suitable maltodextrins include Maltrin M040™ commercially available from Grain Products Processing, and suitable starches or modified starches include Capsul E™ and Amiogum 23™ which are commercially available from National Starch Chemical Co. and American Maze Co., respectively.

The intermediate encapsulating material may include optional additive ingredients such as plasticizers, anti-agglomeration agents, and mixtures thereof. The optional plasticizers include sorbitol, polyethylene glycol, propylene glycol, low molecular weight carbohydrates and the like with a mixture of sorbitol and polyethylene glycol and low molecular weight polyols being the most preferred. The plasticizer is employed at levels of from about 0.01% to about 5%. The anti-agglomeration agents according lo the present invention are preferably a surfactant and are included at low levels of less than 1% of the intermediate encapsulating material. Suitable surfactants for use in the present invention include TWEEN 80™ commercially available from Imperial Chemicals. Inc. (ICI).

External Coating Material

The external coating material is coated on the core particle or, when present, on the intermediate encapsulation material and provides the outer layer of the final particle. The external coating material provides a substantially non-tacky or non-sticky coating for the final particle. Preferably, the external coating provides a particle which will have a non-tacky surface in high humidity conditions such as 80% relative humidity at 90° F.

The external coating is a material derived from one or more at least partially wash-soluble or dispersible compounds. That is, the external coating will either be soluble in an aqueous wash environment or be dispersible in that aqueous wash environment. The compounds useful herein are preferably selected from the following classes of materials.

1. Carbohydrates, which can be any or a mixture of: i) Simple sugars (or monosaccharides): ii) Oligosaccharides (defined as carbohydrate chains consisting of 2–35 monosaccharide molecules); iii) Polysaccharides (defined as carbohydrate chains consisting of at least 35 monosaccharide molecules); and iv) Starches including modified starches and starch hydrolysates; and v) hydrogenates of i), ii), iii), and iv).

Both linear and branched carbohydrate chains may be used. In addition chemically modified starches and poly-/oligo-saccharides may be used. Typical modifications include the addition of hydrophobic moieties of the form of alkyl, aryl, etc. identical to those found in surfactants to impart some surface activity to these compounds.

2. All natural or synthetic gums such as alginate esters, carrageenin, agar-agar, pectic acid, and natural gums such as gum arabic, gum tragacanth and gum karaya.

3. Chitin and chitosan.

4. Cellulose and cellulose derivatives. Examples include: i) Cellulose acetate and Cellulose acetate phthalate (CAP); ii) Hydroxypropyl Methyl Cellulose (HPMC): iii) Carboxymethylcellulose (CMC); iv) all enteric/aquateric coatings and mixtures thereof.

5. Silicates, Phosphates and Borates.

6. Water soluble polymers including polyacrylates, caprolactones, Polyvinyl alcohol (PVA) and Polyethylene glycol (PEG).

7. Waxes, including silicone waxes, paraffinic waxes, and microcrystalline waxes.

8. Plasticizers.

9. Long Chain ($C_{10}$–$C_{35}$) fatty compounds including fatty acids, fatty alcohols and fatty esters.

Materials within these classes which are not at least partially wash soluble or dispersible are useful herein only when mixed in such amounts with the compounds useful herein such that the particle produced has the required hygroscopicity value of less than about 80%. It is also preferred that these compounds be low temperature processable, preferably within the range of from about 50° C. to about 200° C. and more preferably within the range of from about 60° C. to about 180° C.

Preferably, the hydroxylic compound are the cellulose or cellulose derivative materials. Most preferred is hydroxypropyl methyl cellulose commercially available from Aqualori under the tradename METHOCEL.

The external coating may include optional additive ingredients such as plasticizers, anti-agglomeration agents, and mixtures thereof. The optional plasticizers include sorbitol, polyethylene glycol, propylene glycol, low molecular weight carbohydrates and the like with a mixture of sorbitol and polyethylene glycol and low molecular weight polyols being the most preferred. The plasticizer is employed at levels of from about 0.01% to about 5%. The anti-agglomeration agents according to the present invention are preferably a surfactant and are included at low levels of less than 1% of the external coating. Suitable surfactants for use in the present invention include TWEEN 80™ commercially available from Imperial Chemicals, Inc. (ICI).

Laundry and Cleaning Assents

Laundry and cleaning agents are included in the particle of the present invention. The agents are supported on or contained in the porous carrier material as hereinbefore described. Agents useful in the present invention are selected from the group consisting of perfumes, bleaches, bleach promoters, bleach activators, bleach catalysts, chelants, antiscalants, threshold inhibitors, dye transfer inhibitors, photobleaches, enzymes, catalytic antibodies, brighteners, fabric-substantive dyes, antifungals, antimicrobials, insect repellents, soil release polymers, fabric softening agents, dye fixatives, pH jump systems, and mixtures thereof. As can be appreciated for the present invention, these agents which are incorporated into the particles of the present invention may be the same as or different from those agents which are used to formulate the remainder of the laundry and cleaning compositions containing the particle. For example, the particle may comprise a perfume agent and (the same or different) perfume may also be blended into the final composition (such as by spray-on techniques) along with the perfume-containing particle. These agents are selected as desired for the type of composition being formulated, such as granular laundry detergent compositions, granular automatic dishwashing compositions, or hard surface cleaners.

The various types of agents useful in the present invention are described hereinafter. The laundry particle of the present invention may of course be included in a composition which may contain other ingredients. The compositions containing laundry additive particles can optionally include one or more other detergent adjunct materials or other materials for assisting or enhancing cleaning performances treatment of the substrate to be cleaned, or to modify the aesthetics of the detergent composition (e.g., perfumes, colorants, dyes, etc.).

Perfume

The preferred laundry or cleaning agent according to the present invention is a perfume material. As used herein the term "perfume" is used to indicate any odoriferous material which is subsequently released into the aqueous bath and/or onto fabrics contacted therewith. The perfume will most often be liquid at ambient temperatures. A wide variety of chemicals are known for perfume uses, including materials such as aldehydes, ketones, alcohols and esters. More commonly, naturally occurring plant and animal oils and exudates comprising complex mixtures of various chemical components are known for use as perfumes. The perfumes herein can be relatively simple in their compositions or can comprise highly sophisticated complex mixtures of natural and synthetic chemical components, all chosen to provide any desired odor. Typical perfumes can comprise, for example, woody/earthy bases containing exotic materials such as sandalwood, civet and patchouli oil. The perfumes can be of a light floral fragrance, e.g., rose extract, violet extract, and lilac. The perfumes can also be formulated to provide desirable fruity odors, e.g., lime, lemon, and orange. Any chemically compatible material which exudes a pleasant or otherwise desirable odor can be used in the perfumed compositions herein.

Perfumes also include profragrances such as acetal pro-fragrances, ketal pro-fragrances, ester pro-fragrances (e.g., digeranyl succinate), hydrolyzable inorganic-organic pro-fragrances, and mixtures thereof. These pro-fragrances may release the perfume material as a result of simple hydrolysis, or may be pH-change-triggered pro-fragrances (e.g., pH drop) or may be enzymatically releasable pro-fragrances.

Preferred perfume agents useful herein are defined as follows.

For purposes of the present invention compositions exposed to the aqueous medium of the laundry wash process, several characteristic parameters of perfume molecules are important to identify and define: their longest and widest measures, cross sectional area: molecular volume; and molecular surface area. These values are calculated for individual perfume molecules using the CHEMX program (from Chemical Design, Ltd.) for molecules in a minimum energy conformation as determined by the standard geometry optimized in CHEMX and using standard atomic van der Waal radii. Definitions of the parameters are as follows:

"Longest": the greatest distance (in Angstroms) between atoms in the molecule augmented by their van der Waal radii.

"Widest": the greatest distance (in Angstroms) between atoms in the molecule augmented by their van der Waal radii in the projection of the molecule on a plane perpendicular to the "longest" axis of the molecule.

"Cross Sectional Area": area (in square Angstrom units) filled by the projection of the molecule in the plane perpendicular to the longest axis.

"Molecular Volume": the volume (in cubic Angstrom units) filled by the molecule in its minimum energy configuration.

"Molecular Surface Area": arbitrary units that scale as square Angstroms (for calibration purposes, the molecules methyl beta naphthyl ketone, benzyl salicylate, and camphor gum have surface areas measuring 128±3. 163.5±3. and 122.5±3 units respectively).

The shape of the molecule is also important for incorporation. For example, a symmetric perfectly spherical molecule that is small enough to be included into the zeolite channels has no preferred orientation and is incorporated from any approach direction. However, for molecules that have a length that exceeds the pore dimension, there is a preferred "approach orientation" for inclusion. Calculation of a molecule's volume/surface area ratio is used herein to express the "shape index" for a molecule. The higher the value, the more spherical the molecule.

For purposes of the present invention, perfume agents are classified according to their ability to be incorporated into pores of the preferred zeolite carrier, and hence their utility as components for delivery from the preferred zeolite carrier through an aqueous environment. Plotting these agents in a volume/surface area ratio vs. cross sectional area plane permits convenient classification of the agents in groups according to their incorporability into zeolite. In particular, for the zeolite X and Y carriers according to the present invention, agents are incorporated if they fall below the line (herein referred to as the "incorporation line") defined by the equation:

$$y=-0.01068x+1.497$$

where x is cross sectional area and y is volume/surface area ratio. Agents that fall below the incorporation line are referred to herein as "deliverable agents": those agents that fall above the line are referred to herein as "non-deliverable agents".

For containment through the wash, deliverable agents are retained in the preferred zeolite carrier as a function of their affinity for the carrier relative to competing deliverable agents. Affinity is impacted by the molecule's size, hydrophibicity, functionality, volatility, etc., and can be effected via interaction between deliverable agents within the zeolite carrier. These interactions permit improved through the wash containment for the deliverable agents mixture incorporated. Specifically, for the present invention, the use of deliverable agents having at least one dimension that is closely matched to the zeolite carrier pore dimension slows the loss of other deliverable agents in the aqueous wash environment. Deliverable agents that function in this manner are referred to herein as "blocker agents", and are defined herein in the volume/surface area ratio vs. cross sectional area plane as those deliverable agent molecules falling below the "incorporation line" (as defined hereinbefore) but above the line (herein referred to as the "blocker line") defined by the equation:

$$y=-0.01325x+1.46$$

where x is cross sectional area and y is volume/surface area ratio.

For the present invention compositions which utilize zeolite X and Y as the carriers, all deliverable agents below the "incorporation line" can be delivered and released from the present invention compositions, with the preferred materials being those falling below the "blocker line". Also preferred are mixtures of blocker agents and other deliverable agents. Laundry perfume agent mixtures useful for the present invention laundry particles preferably comprise from about 5% to about 100% (preferably from about 25% to about 100%; more preferably from about 50% to about 100%) deliverable agents: and preferably comprising from about 0.1% to about 100% (preferably from about 0.1% to about 50%) blocker agents, by weight of the laundry agents mixture.

Obviously for the present invention compositions whereby perfume agents are being delivered by the compositions, sensory perception is required for a benefit to be seen by the consumer. For the present invention perfume compositions, the most preferred perfume agents useful herein have a threshold of noticability (measured as odor detection thresholds ("ODT") under carefully controlled GC conditions as described in detail hereinafter) less than or equal to 10 parts per billion ("ppb"). Agents with ODTs between 10 ppb and 1 part per million ("ppm") are less preferred. Agents with ODTs above 1 ppm are preferably avoided. Laundry agent perfume mixtures useful for the present invention laundry particles preferably comprise from about 0% to about 80% of deliverable agents with ODTs between 10 ppb and 1 ppm, and from about 20% to about 100% (preferably from about 30% to about 100%: more preferably from about 50% to about 100%) of deliverable agents with ODTs less than or equal to 10 ppb.

Also preferred are perfumes carried through the laundry process and thereafter released into the air around the dried fabrics (e.g., such as the space around the fabric during storage). This requires movement of the perfume out of the zeolite pores with subsequent partitioning into the air around the fabric. Preferred perfume agents are therefore further identified on the basis of their volatility. Boiling point is used herein as a measure of volatility and preferred materials have a boiling point less than 300° C. Laundry agent perfume mixtures useful for the present invention laundry particles preferably comprise at least about 50% of deliverable agents with boiling point less than 300° C. (preferably at least about 60%; more preferably at least about 70%).

In addition, preferred laundry particles herein comprise compositions wherein at least about 80%, and more preferably at least about 90%, of the deliverable agents have a "ClogP value" greater than about 1.0. ClogP values are obtained as follows.

Calculation of CloaP:

These perfume ingredients are characterized by their octanol/water partition coefficient P. The octanol/water partition coefficient of a perfume ingredient is the ratio between its equilibrium concentration in octanol and in water. Since the partition coefficients of most perfume ingredients are large, they are more conveniently given in the form of their logarithm to the base 10, logP.

The logP of many perfume ingredients has been reported; for example, the Pomona92 database, available from Daylight Chemical Information Systems, Inc. (Daylight CIS), contains many, along with citations to the original literature.

However, the logP values are most conveniently calculated by the "CLOGP" program, also available from Daylight CIS. This program also lists experimental logP values when they are available in the Pomona92 database. The "calculated logP" (ClogP) is determined by the fragment approach of Hansch and Leo (cf., A. Leo, in Comprehensive Medicinal Chemistry, Vol. 4, C. Hansch. P. G. Sammens. J. B. Tavlor and C. A. Ramsden, Eds., p. 295, Pergamon Press, 1990). The fragment approach is based on the chemical structure of each perfume ingredient and takes into account the numbers and types of atoms, the atom connectivity, and chemical bonding. The ClogP values, which are the most reliable and widely used estimates for this physicochemical property, can be used instead of the experimental logP values in the selection of perfume ingredients.

Determination of Odor Detection Thresholds:

The gas chromatograph is characterized to determine the exact volume of material injected by the syringe, the precise split ratio, and the hydrocarbon response using a hydrocarbon standard of known concentration and chain-length distribution. The air flow rate is accurately measured and, assuming the duration of a human inhalation to last 0.2 minutes, the sampled volume is calculated. Since the precise concentration at the detector at any point in time is known, the mass per volume inhaled is known and hence the concentration of material. To determine whether a material has a threshold below 10 ppb. solutions are delivered to the sniff port at the back-calculated concentration. A panelist sniffs the GC effluent and identifies the retention time when odor is noticed. The average over all panelists determines the threshold of noticeability.

The necessary amount of analyte is injected onto the column to achieve a 10 ppb concentration at the detector. Typical gas chromatograph parameters for determining odor detection thresholds are listed below.

GC: 5890 Series II with FID detector

7673 Autosampler

Column: J&W Scientific DB-1

Length 30 meters ID 0.25 mm film thickness 1 micron

Method:

Split Injection: 17/1 split ratio

Autosampler: 1.13 microliters per injection

Column Flow: 1.10 mL/minute

Air Flow: 345 mL/minute

Inlet Temp. 245° C.

Detector Temp. 285° C.

Temperature Information

Initial Temperature: 50° C.

Rate: 5C./minute

Final Temperature: 280° C.

Final Time: 6 minutes

Leading assumptions: 0.02 minutes per sniff GC air adds to sample dilution

Perfume Fixative

Optionally, the perfume can be combined with a perfume fixative. The perfume fixative materials employed herein are characterized by several criteria which make them especially suitable in the practice of this invention. Dispersible, toxicologically-acceptable, non-skin irritating, inert to the perfume. degradable and/or available from renewable resources, and relatively odorless additives are used. Perfume fixatives are believed to slow the evaporation of more volatile components of the perfume.

Examples of suitable fixatives include members selected from the group consisting of diethyl phthalate, musks, and mixtures thereof. If used, the perfume fixative comprises from about 10% to abut 50%. preferably from about 20% to about 40%, by weight, of the perfume.

Incororation of Perfume in Preferred Zeolite Carrier

The Type X or Type Y Zeolites to be used as the preferred carrier herein preferably contain less than about 15% desorbable water, more preferably less than about 8% desorbable water, and most preferably less than about 5% desorbable water. Such materials may be obtained by first activating/dehydrating by heating to about 150 to 350° C., optionally with reduced pressure (from about 0.001 to about 20 Torr). After activation, the agent is slowly and thoroughly mixed with the activated zeolite and, optionally, heated to about 60° C. or up to about 2 hours to accelerate absorption equilibrium within the zeolite particles. The perfume/zeolite mixture is then cooled to room temperature and is in the form of a free-flowing powder.

The amount of laundry agent incorporated into the zeolite carrier is less than about 20%, typically less than about 18.5%, by weight of the loaded particle, given the limits on the pore volume of the zeolite. It is to be recognized, however, that the present invention particles may exceed this level of laundry agent by weight of the particle, but recognizing that excess levels of laundry agents will not be incorporated into the zeolite, even if only deliverable agents are used. Therefore, the present invention particles may comprise more than 20% by weight of laundry agents. Since any excess laundry agents (as well as any non-deliverable agents present) are not incorporated into the zeolite pores, these materials are likely to be immediately released to the wash solution upon contact with the aqueous wash medium.

In addition to its function of containing/protecting the perfume in the zeolite particles, the glassy encapsulation material also conveniently serves to agglomerate multiple perfumed zeolite particles into agglomerates having an overall particles size in the range of 200 to 1000 microns, preferably 400 to 600 microns. This reduces dustiness. Moreover, it lessens the tendency of the smaller, individual perfumed zeolites to sift to the bottom of containers filled with granular detergents, which, themselves, typically have particle sizes in the range of 200 to 1000 microns.

Adjunct Laundry or Cleaning Ingredients

Adjunct ingredients useful for in or with the laundry or cleaning compositions according to the present invention are selected from the group consisting of surfactants, perfumes, bleaches, bleach promoters, bleach activators, bleach catalysts, chelants, antiscalants, threshold inhibitors, dye transfer inhibitors, photobleaches, enzymes, catalytic antibodies, brighteners, fabric-substantive dyes, antifungals, antimicrobials, insect repellents, soil release polymers, fabric softening agents, dye fixatives, pH jump systems, and mixtures thereof. As can be appreciated for the present invention, these agents useful for laundry or cleaning compositions which are incorporated into the particulate compositions of the present invention may be the same as or different from those agents which are used to formulate the remainder of the laundry and cleaning compositions containing the particulate compositions produced by the instant process. For example, the particulate compositions may comprise a perfume agent and the same or different agent may also be blended into the final composition along with the perfume-containing particulate composition. These agents are selected as desired for the type of composition being formulated, such as granular laundry detergent compositions, granular automatic dishwashing compositions, or hard surface cleaners.

The various types of agents useful in laundry and cleaning compositions are described hereinafter. The compositions containing particulate compositions can optionally include one or more other detergent adjunct materials or other materials for assisting or enhancing cleaning performance, treatment of the substrate to be cleaned, or to modify the aesthetics of the detergent composition.

Detersive Surfactant

The granules and/or the agglomerates include surfactants at the levels stated previously. The detersive surfactant can be selected from the group consisting of anionic surfactants, nonionic surfactants, cationic surfactants, zwitterionic surfactants and mixtures. Nonlimiting examples of surfactants useful herein include the conventional $C_{11}$–$C_{18}$ alkyl benzene sulfonates ("LAS") and primary, branchedhain and random $C_{10}$–$C_{20}$ alkyl sulfates ("AS"), the $C_{10}$–$C_{18}$ secondary (2.3) alkyl sulfates of the formula $CH_3(CH_2)_X(CHOSO_3^-M^+)$ $CH_3$ and $CH_3$ $(CH_2)_y(CHOSO_3^-M^+)$ $CH_2$, $CH_3$ where x and (y+1) are integers of at least about 7, preferably at least about 9. and M is a water-solubilizing cation, especially sodium, unsaturated sulfates such as oleyl sulfate, the $C_{10}$–$C_{18}$ alkyl alkoxy sulfates ("$AE_xS$"; especially EO 1-7 ethoxy sulfates). $C_{10}$–$C_{18}$ alkyl alkoxy carboxylates (especially the EO 1-5 ethoxycarboxylates), the $C_{10-18}$ glycerol ethers, the $C_{10}$–$C_{18}$ alkyl polyglycosides and their corresponding sulfated polyglycosides, and $C_{12}$–$C_{18}$ alpha-sulfonated fatty acid esters. If desired, the conventional nonionic and amphoteric surfactants such as the $C_{12}$–$C_{18}$ alkyl ethoxylates ("AE") including the so-called narrow peaked alkyl ethoxylates and $C_6$–$C_{12}$ alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and the like, can also be included in the overall compositions. The $C_{10}$–$C_{18}$ N-alkyl polyhydroxy fatty acid amides can also be used. Typical examples include the $C_{12}$–$C_{18}$ N-methylglucamides. See WO 9.206.154. Other sugar-derived surfactants include the N-alkoxy polyhydroxy fatty acid amides, such as $C_{10}$–$C_{18}$ N-(3-methoxypropyl) glucamide. The N-propyl through N-hexyl $C_{12}$–$C_{18}$ glucamides can be used for low sudsing. $C_{10}$–$C_{20}$ conventional soaps may also be used. If high sudsing is desired, the branched-chain $C_{10}$–$C_{16}$ soaps may be used. Mixtures of anionic and nonionic surfactants are especially useful. Other conventional useful surfactants are listed in standard texts.

The $C_{10}$–$C_{18}$ alkyl alkoxy sulfates ("$AE_xS$"; especially EO 1-7 ethoxy sulfates) and $C_{12}$–$C_{18}$ alkyl ethoxylates ("AE") are the most preferred for the cellulose-containing detergents described herein.

Detersive Builder

The granules and agglomerates preferably include a builder at the previously stated levels. To that end, inorganic as well as organic builders can be used. Also, crystalline as well as amorphous builder materials can be used. Builders are typically used in fabric laundering compositions to assist in the removal of particulate soils and to eliminate water hardness.

Inorganic or P-containing detergent builders include, but are not limited to the alkali metal, ammonium and alkanolammonium salts of polyphosphates (exemplified by the tripolyphosphates, pyrophosphates, and glassy polymeric meta-phosphates), phosphonates, phytic acid, silicates, carbonates (including bicarbonates and sesquicarbonates), sulphates, and aluminosilicates. However, non-phosphate builders are required in some locales. Importantly, the compositions herein function surprisingly well even in the presence of the so-called "weak" builders (as compared with phosphates) such as citrate, or in the so-called "under built" situation that may occur with zeolite or layered silicate builders.

Examples of silicate builders are the alkali metal silicates, particularly those having a $SiO_2$:$Na_2O$ ratio in the range 1.6:1 to 3.2:1 and layered silicates such as the layered sodium silicates described in U.S. Pat. No. 4,664,839, issued May 12, 1987 to H. P. Rieck, NaSKS-6 is the trademark for a crystalline layered silicate marketed by Hoechst (commonly abbreviated herein as "SKS-6"). Unlike zeolite builders, the Na SKS-6 silicate builder does not contain aluminum. NaSKS-6 has the delta-$Na_2SiO_5$ morphology form of layered silicate. It can be prepared by methods such as those described in German DE-A-3,417,649 and DE-A-3,742,043, SKS-6 is a highly preferred layered silicate for use herein, but other such layered silicates, such as those having the general formula $NaMSi_xO_{2x+1}.yH_2O$ wherein M is sodium or hydrogen, x is a number from 1.9 to 4, preferably 2, and y is a number from 0 to 20, preferably 0 can be used herein. Various other layered silicates from Hoechst include NaSKS-5. NaSKS-7 and NaSKS-11, as the alpha beta and gamma forms. As noted above, the delta-$Na_2SiO_5$ (NaSKS-6 form) is most preferred for use herein. Other silicates may also be useful such as for example magnesium silicate, which can serve as a crispening agent in granular formulations, as a stabilizing agent for oxygen bleaches, and as a component of suds control systems.

Examples of carbonate builders are the alkaline earth and alkali metal carbonates as disclosed in German Patent Application No. 2,321,001 published on Nov. 15, 1973. As mentioned previously, aluminosilicate builders are useful builders in the present invention. Aluminosilicate builders are of great importance in most currently marketed heavy duty granular detergent compositions, and can also be a significant builder ingredient in liquid detergent formulations. Aluminosilicate builders include those having the empirical formula:

$$M_Z(zAlO_2)_y].xH_2O$$

wherein z and y are integers of at least 6, the molar ratio of z to y is in the range from 1.0 to about 0.5, and x is an integer from about 15 to about 264.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669, Krummel, et al. issued Oct, 12, 1976. Preferred synthetic crystalline aluminosilicate ion exchange materials useful herein are available under the designations Zeolite A, Zeolite P (B), Zeolite MAP and Zeolite X. In an especially preferred embodiment, the crystalline aluminosilicate ion exchange material has the formula:

$$Na_{12}[AlO_2)_{12}(SiO_2))_{12}].xH_2O$$

wherein x is from about 20 to about 30, especially about 27. This material is known as Zeolite A. Dehydrated zeolites (x=0–10) may also be used herein. Preferably, the aluminosilicate has a particle size of about 0.1–10 microns in diameter.

Organic detergent builders suitable for the purposes of the present invention include, but are not restricted to, a wide variety of polycarboxylate compounds. As used herein, "polycarboxylate" refers to compounds having a plurality of carboxylate groups, preferably at least 3 carboxylates. Polycarboxylate builder can generally be added to the composition in acid form, but can also be added in the form of a neutralized salt. When utilized in salt form, alkali metals, such as sodium, potassium, and lithium, or alkanolammonium salts are preferred.

Included among the polycarboxylate builders are a variety of categories of useful materials. One important category of polycarboxylate builders encompasses the ether polycarboxylates, including oxydisuccinate, as disclosed in Berg, U.S. Pat. No. 3,128,287, issued Apr. 7, 1964, and Lamberti et al. U.S. Pat. No. 3,635,830, issued Jan. 18, 1972, See also "TMS/TDS" builders of U.S. Pat. No. 4,663,071, issued to Bush et al. on May 5, 1987, Suitable ether polycarboxylates also include cyclic compounds, particularly alicyclic compounds, such as those described in U.S. Pat. Nos. 3,923,679, 3,835,163; 4,158,635, 4,120,874 and 4,102,903.

Other useful detergency builders include the ether hydroxypolycarboxylates, copolymers of maleic anhydride with ethylene or vinyl methyl ether, 1, 3, 5-trihydroxy benzene-2, 4, 6-trisulphonic acid, and carboxymethyloxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid and soluble salts thereof.

Citrate builders, e.g., citric acid and soluble salts thereof (particularly sodium salt), are polycarboxylate builders of particular importance for heavy duty liquid detergent formulations due to their availability from renewable resources and their biodegradability. Citrates can also be used in granular compositions. Especially in combination with zeolite and/or layered silicate builders. Oxydisuccinates are also especially useful in such compositions and combinations.

Also suitable in the detergent compositions of the present invention are the 3,3-dicarboxy-4-oxa-1,6-hexanedioates and the related compounds disclosed in U.S. Pat. No. 4,566,984, Bush, issued Jan. 28, 1986. Useful succinic acid builders include the $C_5$–$C_{20}$ alkyl and alkenyl succinic acids and salts thereof. A particularly preferred compound of this type is dodecenylsuccinic acid. Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group, and are described in European Patent Application 86200690,5/0,200,263, published Nov. 5, 1986.

Other suitable polycarboxylates are disclosed in U.S. Pat. No. 4,144,226, Crutchfield et al. issued Mar. 13, 1979 and in U.S. Pat. No. 3,308,067, Diehl, issued Mar. 7, 1967. See also Diehl U.S. Pat. No. 3,723,322.

Fatty acids, e.g., $C_{12}$–$C_{18}$ monocarboxylic acids, can also be incorporated into the compositions alone, or in combination with the aforesaid builders, especially citrate and/or the succinate builders, to provide additional builder activity. Such use of fatty acids will generally result in a diminution of sudsing, which should be taken into account by the formulator.

In situations where phosphorus-based builders can be used, and especially in the formulation of bars used for hand-laundering operations, the various alkali metal phosphates such as the well-known sodium tripolyphosphates, sodium pyrophosphate and sodium orthophosphate can be used. Phosphonate builders such as ethane-1-hydroxy-1,1-diphosphonate and other known phosphonates (see, for example, U.S. Pat. Nos. 3,159,581, 3,213,030; 3,422,021; 3,400,148 and 3,422,137) can also be used.

Other Adjunct Ingredients

The composition of the present invention may also include enzymes, enzyme stabilizers, brighteners, polymeric dispersing agents (i.e. polyacrylates), carriers, hydrotropes, suds boosters or suppressors, soil release agents, dye transfer inhibitors, and processing aids.

Granular Compositions

The laundry and cleaning compositions of the present invention can be used in both low density (below 550 grams/liter) and high density granular compositions in which the density of the granule is at least 550 grams/liter. Granular compositions are typically designed to provide an in the wash pH of from about 7.5 to about 11.5, more preferably from about 9.5 to about 10.5. Low density compositions can be prepared by standard spray-drying processes. Various means and equipment are available to prepare high density compositions. Current commercial practice in the field employs spray-drying towers to manufacture compositions which have a density less than about 500 g/l. Accordingly, if spray-drying is used as part of the overall process, the resulting spray-dried particles must be further densified using the means and equipment described hereinafter. In the alternative, the formulator can eliminate spray-drying by using mixing, densifying and granulating equipment that is commercially available. The following is a nonlimiting description of such equipment suitable for use herein.

Various means and equipment are available to prepare high density (i.e., greater than about 550, preferably greater than about 650, grams/liter or "g/l"). high solubility, free-flowing, granular detergent compositions according to the present invention. Current commercial practice in the field employs spray-drying towers to manufacture granular laundry detergents which often have a density less than about 500 g/l. In this procedure, an aqueous slurry of various heat-stable ingredients in the final detergent composition are formed into homogeneous granules by passage through a spray-drying tower, using conventional techniques, at temperatures of about 175° C. to about 225° C. However, if spray drying is used as part of the overall process herein, additional process steps as described hereinafter must be used to obtain the level of density (i.e., >650 g/l) required by modem compact, low dosage detergent products.

For example, spray-dried granules from a tower can be densified further by loading a liquid such as water or a nonionic surfactant into the pores of the granules and/or subjecting them to one or more high speed mixer/densifiers. A suitable high speed mixer/densifier for this process is a device marketed under the tradename "Lödige CB 30" or "Lödige CB 30 Recycler" which comprises a static cylindrical mixing drum having a central rotating shaft with mixing/cutting blades mounted thereon. In use, the ingredients for the detergent composition are introduced into the drum and the shaft/blade assembly is rotated at speeds in the range of 100–2500 rpm to provide thorough mixing/densification. See Jacobs et al. U.S. Pat. No. 5,149,455, issued Sep. 22, 1992. The preferred residence time in the high speed mixer/densifier is from about 1 to 60 seconds. Other such apparatus includes the devices marketed under the tradename "Shugi Granulator" and under the tradename "Drais K-TTP 80).

Another process step which can be used to densify further spray-dried granules involves grinding and agglomerating or deforming the spray-dried granules in a moderate speed mixer/densifier so as to obtain particles having lower intra-particle porosity. Equipment such as that marketed under the tradename "Lödige KM" (Series 300 or 600) or "Lodige Ploughshare" mixer/densifiers are suitable for this process step. Such equipment is typically operated at 40–160 rpm. The residence time of the detergent ingredients in the moderate speed mixer/densifier is from about 0.1 to 12 minutes. Other useful equipment includes the device which is available under the tradename "Drais K-T 160". This process step which employs a moderate speed mixer/densifier (eg. Lödige KM) can be used by itself or sequentially with the aforementioned high speed mixer/densifier (e.g. Lödige CB) to achieve the desired density. Other types of granules manufacturing apparatus useful herein include the apparatus disclosed in U.S. Pat. No. 2,306,898, to G. L. Heller, Dec. 29, 1942.

While it may be more suitable to use the high speed mixer/densifier followed by the low speed mixer/densifier, the reverse sequential mixer/densifier configuration is also contemplated by the invention. One or a combination of various parameters including residence times in the mixer/densifiers, operating temperatures of the equipment, temperature and/or composition of the granules, the use of adjunct ingredients such as liquid binders and flow aids, can be used to optimize densification of the spray-dried granules in the process of the invention, By way of example, see the processes in Appel et al. U.S. Pat. No. 5,133,924, issued Jul. 28, 1992 (granules are brought into a deformable state prior to densification): Delwel et al. U.S. Pat. No. 4,637,891, issued Jan. 20, 1987 (granulating spray-dried granules with a liquid binder and aluminosilicate); Kruse et al. U.S. Pat. No. 4,726,908, issued Feb. 23, 1988 (granulating spray-dried granules with a liquid binder and aluminosilicate); and, Bortolotti et al. U.S. Pat. No. 5,160,657, issued Nov. 3, 1992 (coating densified granules with a liquid binder and aluminosilicate).

In those situations in which particularly heat sensitive or highly volatile detergent ingredients are to be incorporated into the final detergent composition, processes which do not include spray drying towers are preferred. The formulator can eliminate the spray-drying step by feeding, in either a continuous or batch mode, starting detergent ingredients directly into mixing/densifying equipment that is commercially available. One particularly preferred embodiment involves charging a surfactant paste and an anhydrous builder material into a high speed mixer/densifier (e.g. L ödige CB) followed by a moderate speed mixer/densifier (e.g. Lödige KM) to form high density detergent agglomerates. See Capeci et al. U.S. Pat. No. 5,366,652, issued Nov. 22, 1994 and Capeci et al. U.S. Pat. No. 5,486,303, issued Jan. 23, 1996. Optionally, the liquid/solids ratio of the starting detergent ingredients in such a process can be selected to obtain high density agglomerates that are more free flowing and crisp.

Optionally, the process may include one or more recycle streams of undersized particles produced by the process which are fed back to the mixer/densifiers for further agglomeration or build-up. The oversized particles produced by this process can be sent to grinding apparatus and then fed back to the mixing/densifying equipment. These additional recycle process steps facilitate build-up agglomeration of the starting detergent ingredients resulting in a finished composition having a uniform distribution of the desired particle size (400–700 microns) and density (>550 g/l). See Capeci et al. U.S. Pat. No. 5,516,448, issued May 14, 1996 and Capeci et al. U.S. Pat. No. 5,489,392. issued Feb. 6, 1996. Other suitable processes which do not call for the use of spray-drying towers are described by Bollier et al. U.S. Pat. No. 4,828,721, issued May 9, 1989; Beerse et al. U.S. Pat. No. 5,108,646, issued Apr. 28, 1992: and, Jolicoeur, U.S. Pat. No. 5,178,798, issued Jan. 12, 1993.

In yet another embodiment the high density detergent composition of the invention can be produced using a fluidized bed mixer. In this process, the various ingredients of the finished composition are combined in an aqueous slurry (typically 80% solids content) and sprayed into a fluidized bed to provide the finished detergent granules. Prior to the fluidized bed, this process can optionally include the step of mixing the slurry using the aforementioned L ödige CB mixer/densifier or a "Flexomix 160" mixer/densifier, available from Shugi. Fluidized bed or moving beds of the type available under the tradename "Escher Wyss" can be used in such processes.

Another suitable process which can be used herein involves feeding a liquid acid precursor of an anionic surfactant, an alkaline inorganic material (e.g. sodium carbonate) and optionally other detergent ingredients into a high speed mixer/densifier (residence time 5–30 seconds) so as to form agglomerates containing a partially or totally neutralized anionic surfactant salt and the other starting detergent ingredients. Optionally, the contents in the high speed mixer/densifier can be sent to a moderate speed mixer/densifier (e.g. Lödige KM) for further agglomeration resulting in the finished high density detergent composition. See Appel et al. U.S. Pat. No. 5,164,108, issued Nov. 17, 1992.

Optionally, high density detergent compositions according to the invention can be produced by blending conventional or densified spray-dried detergent granules with detergent agglomerates in various proportions (e.g. a 60:40 weight ratio of granules to agglomerates) produced by one or a combination of the processes discussed herein. Additional adjunct ingredients such as enzymes, perfumes, brighteners and the like can be sprayed or admixed with the agglomerates, granules or mixtures thereof produced by the processes discussed herein. Bleaching compositions in granular form typically limit water content, for example, to less than about 7% free water, for best storage stability.

Deposition of Perfume onto Fabric Surfaces

The method of washing fabrics and depositing perfume thereto comprises contacting said fabrics with an aqueous wash liquor comprising at least about 100 ppm of conventional detersive ingredients described hereinabove, as well as at least about 0.1 ppm of the above-disclosed laundry additive particle. Preferably, said aqueous liquor comprises from about 500 ppm to about 20,000 ppm of the conventional detersive ingredients and from about 10 ppm to about 200 ppm of the laundry additive particle.

The laundry additive particle works under all circumstances, but is particularly useful for providing odor benefits on fabrics during storage, drying or ironing. The method comprises contacting fabrics with an aqueous liquor containing at least about 100 ppm of conventional detersive ingredients and at least about 1 ppm of the laundry additive particle such that the perfumed zeolite particles are entrained on the fabrics, storing line-dried fabrics under ambient conditions with humidity of at least 20%, drying the fabric in a conventional automatic dryer, or applying heat to fabrics which have been line-dried or machine dried at low heat (less than about 50° C.) by conventional ironing means (preferably with steam or pre-wetting).

The following nonlimiting examples illustrate the parameters of and compositions employed within the invention. All percentages, parts and ratios are by weight unless otherwise indicated.

EXAMPLE I

A laundry additive particle according to the present invention is produced via the following process. A solution of 75% solid carbohydrate material (hydrogenated starch hydrolysate—POLYSORB RA-1000 from Roquette America) and the balance water is premixed in an agitated mixing vessel with 1.5% by weight $TiO_2$ powder (commercially sold under the trade name Tronox by the Kerr McGee Chemical Corporation) to form a carbohydrate encapsulation fluid solution. The carbohydrate fluid is dried to a moisture content of about 2.0% in a Luwa™ Wiped Film Evaporator ("WFE"). Thereafter, the carbohydrate fluid and zeolite X loaded with 16% perfume by weight ("PLZ") are inputted at a weight ratio of 1:1 into a 12 barrel. Werner & Pfleiderer™ ZSK 30 twin screw extruder ("TSE") without a constricting die plate to form agglomerates. Barrels 1 through 4 of the TSE are maintained at a temperature of 80° C. while barrels 5 and 6 are maintained at a temperature of 90° C. barrels 7 and 8 at a temperature of 130° C. barrels 9 and 10 at a temperature of 135° C. and barrels 11 and 12 at a temperature of 130° C. The carbohydrate fluid is fed at a temperature of 160° C. to the TSE in barrel 7, while the PLZ is added in barrel 11 and intimately mixed with the carbohydrate fluid prior to leaving the TSE as an extrudate having a discharge temperature of 145° C. and a rate of 500 g/min. The product is cooled at room temperature to form free flowing particles which are ground in a Fitz Mill™ (commercially available from the Fitzpatrick Company) and sized via screening to result in particles in the size range of 150 microns to 1180 microns. The sized particles are then sent to a Wurster fluid bed coater in which an aqueous mixture containing 22.5% of Maltrin 040™ (having a dextrose equivalent of 5) commercially available from Grain Processing Corp. 1.0% of D-Sorbitol™ commercially available from J. T. Baker, 1.0% of polyethylene glycol (Carbowax™ PEG 600 commercially available from Union Carbide), and 0.5% of surfactant (TWEEN 80™ commercially available from Imperial Chemicals. Inc. (ICI)) is added. The Maltrin 040™ coated particles are then sent to a second Wurster fluid bed coater in which an aqeuous mixture containing 8.10% hydroxpypropyl methyl cellulose (under the tradename Methocel™ E-15LV from Dow Chemicals), 1% titanium oxide whitening agent and 0.90% polyethylene glycol 600 (under the tradename Carbowax™ from Union Carbide) is added. The coated particles are dried to produce a particulate composition suitable for use as a laundry additive composition.

The particles formed unexpectedly have a superior "Neat Product Odor" ("NPO") and emits only minimal detectable odors over the base product odor as observed by a statistically significant number of panelist graders. This provides strong evidence of the lack of perfume displacement from the carrier particles.

EXAMPLE II

Several detergent compositions made in accordance with the invention and are exemplified below incorporating the perfume particle prepared in Example 1.

| Base Granule | A | B | C |
|---|---|---|---|
| Aluminosilicate | 18.0 | 22.0 | 24.0 |
| Sodium Sulfate | 10.0 | 19.0 | 6.0 |

-continued

| Base Granule | A | B | C |
|---|---|---|---|
| Sodium Polyacrylate Polymer | 3.0 | 2.0 | 4.0 |
| PolyethyleneGlycol (MW = 400) | 2.0 | 1.0 | — |
| $C_{12-13}$ Linear Alkylbenzene Sulfonate. Na | 6.0 | 7.0 | 8.0 |
| $C_{14-6}$ Secondary Alkyl Sulfide Na | 3.0 | 3.0 | — |
| $C_{14-15}$ Alkyl Ethoxylated Sulfate. Na | 3.0 | 9.0 | — |
| Sodium Silicate | 1.0 | 2.0 | 3.0 |
| Brightener 24/47[1] | 0.3 | 0.3 | 0.3 |
| Sodium Carbonate | 7.0 | 26.0 | |
| Carboxymethyl Cellulose | — | — | 1.0 |
| DTPMPA[2] | — | — | 0.5 |
| DTPA[3] | 0.5 | — | — |
| Admixed Agglomerates | | | |
| $C_{14-15}$ Alkyl Sulfate. Na | 5.0 | — | — |
| $C_{12-13}$ Linear Alkylbenzene Sulfonate. Na | 2.0 | — | — |
| Sodium Carbonate | 4.0 | — | — |
| Polyethylene Glycol (MW = 4000) | 1.0 | — | — |
| Admix | | | |
| Sodium Carbonate | — | — | 13.0 |
| $C_{12-15}$ Alkyl Ethoxylate (EO = 7) | 2.0 | 0.5 | 2.0 |
| $C_{12-15}$ Alkyl Ethoxylate (EO = 3) | — | — | 2.0 |
| Perfume Spray-On | 0.3 | 0.4 | 0.3 |
| Perfume Particles[4] | 0.5 | 0.5 | 0.5 |
| Polyvinylpyrrilidone | 0.5 | — | — |
| Polyvinylpyridine N-oxide | 0.5 | — | — |
| Polyvinyipyrrolidone-polyvinylimidazole | 0.5 | — | — |
| Distearylamine & Cumene Sulfonic Acid | 2.0 | — | — |
| Soil Release Polymer[5] | 0.5 | — | — |
| Lipolase Lipase (100.000 LU/I)[6] | 0.5 | — | 0.5 |
| Termamyl Amylase (60 KNU/g)hu 6 | 0.3 | — | 0.3 |
| CAREZYME ® Cellulase (1000 CEVU/g)[6] | 0.3 | — | — |
| Protease (40 mg/g)[7] | 0.5 | 0.5 | 0.5 |
| NOBS[8] | 5.0 | — | — |
| TAED[9] | — | — | 3.0 |
| Sodium Percarbonate | 12.0 | — | — |
| Sodium Perborate Monohydrate | — | — | 22.0 |
| Polydimethylsiloxane | 0.3 | — | 3.0 |
| Sodium Sulfate | — | — | 3.0 |
| Miscellaneous (water. etc.) | balance | balance | balance |
| Total | 100 | 100 | 100 |

1. Purchased from Ciba-Geigy
2. Diethylene Triamine PentaMethylene Phosophonic Acid
3. Diethylene Triamine Pentaacetic Acid
4. From Example I
5. Made according to U.S. Pat. No. 5,415.807, issued May 16. 1995 to Gosselink et al
6. Purchased from Novo Nordisk A/S
7. Purchased from Genencor
8. Nonanoyloxybenzenesulfonate
9. Tetra Acetyl Ethylene Diamine

EXAMPLE III

The following detergent compositions according to the invention are suitable for machine and handwashing operations. The base granule is prepared by a conventional spray drying process in which the starting ingredients are formed into a slurry and passed through a spray drying tower having a counter current stream of hot air (200–400 C.) resulting in the formation of porous granules. The remaining adjunct detergent ingredients are sprayed on or added dry.

| Base Granule | A | B | C |
|---|---|---|---|
| $C_{12-13}$ Alkylbenzene Sulfonate. Na | 19.0 | 18.0 | 19.0 |
| Cationic Surfactant[1] | 0.5 | 0.5 | — |
| DTPMPA[2] | 0.3 | — | — |
| DTPA[3] | — | 0.3 | — |
| Sodium Tripolyphosphate | 25.0 | 19.0 | 29.0 |
| Acrylic/Maleic Co-polymer | 1.0 | 0.6 | — |
| Carboxymethylcellulose | 0.3 | 0.2 | 0.3 |
| Brightener 49/15/33[4] | 0.2 | 0.2 | 0.2 |
| Sodium Sulfate | 28.0 | 39.0 | 15.0 |
| Sodium Silicate (2.0R) | 7.5 | — | — |
| Sodium Silicate (1.6R) | — | 7.5 | 6.0 |
| Admix | | | |
| Quantum (zinc phthalocyanine sulfonate) | 2.0 | 2.0 | 2.0 |
| Sodium Carbonate | 5.0 | 6.0 | 20.0 |
| $C_{12-13}$ Alkly Ethoxylate (EO = 7) | 0.4 | — | 1.2 |
| Savinase[5] Protease (4KNPY/g) | 0.6 | — | 1.0 |
| Termamyl[5] Amylase (60KNU/g), | 0.4 | — | — |
| Lipolase[5] Lipase (100.000 LU/I) | 0.1 | 0.1 | 0.1 |
| Sav/Ban[5] (6 KNPU/100 KNU/g) | — | 0.3 | — |
| CAREZYME 200 [5] Cellulase (1000 CEVU/g) | — | 0.1 | — |
| Soil Release Polymer[6] | 0.1 | 0.1 | 0.3 |
| Perfume Spray-On | 0.4 | 0.4 | 0.4 |
| Perfume Particles[7] | 1.5 | 1.5 | 2.0 |
| Miscellaneous (water. etc.) | balance | balance | balance |
| Total | 100.0 | 100.0 | 100.0 |

1. $C_{12-14}$ Dimethyl Hydroxyethyl Quatemary Ammonium Compound
2. Diethylene Triamine Pentamethylenephosphoric Acid
3. Diethylene Triamine Pentaacetic Acid
4. Purchased from Ciba-Geigy
5. Purchased from Novo Nordisk A/S
6. Made according to U.S. Pat. No. 5,415.807 issued May 16. 1995 to Gosselink et al
7. From Example 1

EXAMPLE IV

The following detergent composition according to the invention is in the form of a laundry bar which is particularly suitable for handwashing operations.

| | % Weight |
|---|---|
| Coconut Fatty Alkyl Sulfate | 30.0 |
| Sodium Tripolyphosphate | 5.0 |
| Tetrasodium Pyrophosphate | 5.0 |

-continued

| | % Weight |
|---|---|
| Sodium Carbonate | 20.0 |
| Sodium Sulfate | 5.0 |
| Calcium Carbonate | 5.0 |
| $Na_{1.9}K_{0.1}Ca(CO_3)_2$ | 15.0 |
| Aluminosilicate | 2.0 |
| Coconut Fatty Alcohol | 2.0 |
| Perfume Particle[1] | 1.0 |
| Perfume Spray-On | 1.0 |
| Miscellaneous (water. etc.) | Balance |
| Total | 100.0 |

1. From Example I.

Having thus described the invention in detail, it will be clear to those skilled in the art that various changes may be made without departing from the scope of the invention and the invention is not to be considered limited to what is described in the specification

What is claimed is:

1. A laundry additive particle comprising:

i) a central core particle, said core particle comprising a porous carrier core material and a glassy encapsulating material intermixed with said carrier material; said glassy encapsulating material derived from one or more at least partially water-soluble hydroxylic compounds having an anhydrous, nonplasticized, glass transition temperature, $T_g$, of at least 0° C. and said porous carrier core material is selected from the group consisting of amorphous silicates, crystalline nonlayer silicates, layer silicates, calcium carbonates, calcium/sodium carbonate double salts, sodium carbonates, clays, zeolites, sodalites, alkali metal phosphates, macroporous zeolites, chitin microbeads, carboxyalkylcelluloses, carboxyalkylstarches, cyclodextrins, porous starches and mixtures thereof;

ii) an intermediate encapsulating material coated on said central core particle, said intermediate encapsulating material comprising a carbohydrate material having an anhydrous, nonplasticized, glass transition temperature, $T_g$, of at least 130° C.; and iii) an external coating material coated on said intermediate encapsulating material and providing said laundry additive particle with a substantially non-tacky surface; said external coating material being derived from one or more at least partially wash soluble or dispersible compounds selected from the group consisting of waxes, water soluble polymers, fatty compounds, carbohydrates, cellulose and cellulose derivatives, natural and synthetic gums, silicates, borates, phosphates, chitin and chitosan, and mixtures thereof;

wherein said laundry additive particle has a hygroscopicity value of less than 80%.

2. The laundry additive particle as claimed in claim 1 wherein said porous carrier material is a zeolite and said zeolite is selected from the group consisting of Zeolite X, Zeolite Y, and mixtures thereof.

3. The laundry additive particle as claimed in claim 1 wherein said laundry additive particle further comprises a laundry or cleaning agent contained in or supported on said porous carrier material; said laundry or cleaning agent being selected from the group consisting of perfumes, bleaches, bleach promoters, bleach activators, bleach catalysts, chelants, antiscalants, threshold inhibitors, dye transfer inhibitors, photobleaches, enzymes, catalytic antibodies, brighteners, fabric-substantive dyes, antifungals, antimicrobials, insect repellents, soil release polymers, fabric softening agents, dye fixatives, pH jump systems, and mixtures thereof.

4. The laundry additive particle as claimed in claim 3 wherein said laundry or cleaning agent is a perfume material.

5. The laundry additive particle as claimed in claim 1 wherein said glassy encapsulating material is a a starch, modified starch or starch hydrolysate.

6. The laundry additive particle as claimed in claim 1 wherein said intermediate encapsulating material is a carbohydrate material having a dextrose equivalence, DE, of about 7.5 or less.

7. The laundry additive particle as claimed in claim 6 wherein said intermediate encapsulating material is a maltodextrin.

8. The laundry additive particle as claimed in claim 1 wherein said external coating material is cellulose or cellulose derivative.

9. The laundry additive particle as claimed in claim 8 wherein said external coating material is hydroxypropyl methyl cellulose.

10. The laundry additive particle as claimed in claim 1 wherein said laundry additive particle has a hygroscopicity value of less than about 30%.

11. The laundry additive particle as claimed in claim 6 wherein said intermediate encapsulating material and said external coating further includes an ingredient selected from the group consisting of plasticizers, anti-agglomeration agents, and mixtures thereof.

12. A laundry or cleaning detergent composition comprising:

A) from about 0.001% to about 50% by weight of the composition of a laundry additive particle comprising:

i) a central core particle, said core particle comprising a porous carrier core material and a glassy encapsulating material intermixed with said carrier material; said glassy encapsulating material derived from one or more at least partially water-soluble hydroxylic compounds having an anhydrous, nonplasticized, glass transition temperature, $T_g$, of at least about 0° C. and said porous carrier core material is selected from the group consisting of amorphous silicates, crystalline nonlayer silicates, layer silicates, calcium carbonates, calcium/sodium carbonate double salts, sodium carbonates, clays, zeolites, sodalites, alkali metal phosphates, macroporous zeolites, chitin microbeads, carboxyalkylcelluloses, carboxyalkylstarches, cyclodextrins, porous starches and mixtures thereof;

ii) an intermediate encapsulating material coated on said central core particle, said intermediate encapsulating material comprising a carbohydrate material having an anhydrous, nonplasticized, glass transition temperature, $T_g$, of at least about 130° C.; and iii) an external coating material coated on said intermediate encapsulating material and providing said laundry additive particle with a substantially non-tacky surface; said external coating material being derived from one or more at least partially wash soluble or dispersible compounds selected from the group consisting of waxes, water soluble polymers, fatty compounds, carbohydrates, cellulose and cellulose derivatives, natural and synthetic gums, silicates, borates, phosphates, chitin and chitosan, and mixtures thereof; wherein said laundry additive particle has a hygroscopicity value of less than about 80%; and B) from about 50% to about 99.999% by weight of the composition of laundry ingredients selected from the group consisting of detersive surfactants, builders, bleaching agents, enzymes, soil release polymers, dye transfer inhibitors, fillers and mixtures thereof.

13. The laundry or cleaning detergent composition as claimed in claim 12 wherein the laundry ingredients are at least one detersive surfactant and at least one builder.

14. The laundry or cleaning detergent composition as claimed in claim 12 wherein said porous carrier material is a zeolite and said zeolite is selected from the group consisting of Zeolite X, Zeolite Y, and mixtures thereof.

15. The laundry or cleaning detergent composition as claimed in claim 12 wherein said laundry additive particle further comprises a laundry or cleaning agent contained in or supported on said porous carrier material; said laundry or cleaning agent being selected from the group consisting of perfumes, bleaches, bleach promoters, bleach activators, bleach catalysts, chelants, antiscalants, threshold inhibitors, dye transfer inhibitors, photobleaches, enzymes, catalytic antibodies, brighteners, fabric-substantive dyes, antifungals, antimicrobials, insect repellents, soil release polymers, fabric softening agents, dye fixatives, pH jump systems, and mixtures thereof.

16. The laundry or cleaning composition as claimed in claim 12 wherein said glassy encapsulating material is a starch, modified starch or starch hydrolysate.

17. The laundry or cleaning composition as claimed in claim 12 wherein said intermediate encapsulating material is a carbohydrate material having a dextrose equivalence, DE, of about 7.5 or less.

18. The laundry or cleaning composition as claimed in claim 17 wherein said intermediate encapsulating material is a maltodextrin.

19. The laundry or cleaning composition as claimed in claim 12 said external coating material is cellulose or cellulose derivative.

20. The laundry or cleaning composition as claimed in claim 19 wherein said external coating material is hydroxypropyl methyl cellulose.

* * * * *